United States Patent [19]

McWilliams

[11] 4,320,691

[45] Mar. 23, 1982

[54] HYDRAULIC LOAD LIFTING SYSTEM WITH HYDRAULIC SURCHARGE TO MAKE UP VALVE PILOT LINES

[75] Inventor: Orcenith D. McWilliams, Morris, Ill.

[73] Assignee: Caterpillar Tractor Co., Peoria, Ill.

[21] Appl. No.: 143,996

[22] PCT Filed: Nov. 16, 1979

[86] PCT No.: PCT/US79/00994

§ 371 Date: Nov. 16, 1979

§ 102(e) Date: Nov. 16, 1979

[51] Int. Cl.[3] ..... F15B 13/042

[52] U.S. Cl. ..... 91/437; 91/438; 91/441; 91/451; 91/464; 137/596.15; 137/625.63

[58] Field of Search ..... 91/437, 438, 439, 441, 91/464, 451; 137/625.63, 596.15

[56] References Cited

U.S. PATENT DOCUMENTS

| | | | |
|---|---|---|---|
| 2,219,967 | 10/1940 | Thiry | 91/437 |
| 2,597,418 | 5/1952 | Westbury et al. | 91/437 X |
| 3,049,101 | 8/1962 | Ruhl | 137/596.15 X |
| 3,433,131 | 3/1969 | Soyland et al. | 91/447 |
| 3,608,435 | 9/1971 | Conabfe et al. | 91/45 X |
| 3,709,103 | 1/1973 | Dukhovny et al. | 91/437 |
| 3,840,049 | 10/1974 | Field, Jr. | 137/625.63 |
| 3,862,643 | 1/1975 | Dezflan et al. | 137/625.63 |
| 3,943,825 | 3/1976 | Bianchetta et al. | 137/596.15 |

*Primary Examiner*—Irwin C. Cohen

*Attorney, Agent, or Firm*—Phillips, Moore, Weissenberger, Lempio & Majestic

[57] ABSTRACT

A hydraulic system (9) includes a hydraulic motor (10), a main control valve (17) for controlling said motor (10), a make-up valve (78,79) operatively associated with said main control valve (17) and a vent line (93,94,95,99) for selectively venting said make-up valve (78,79). In such hydraulic systems, and in particular, in prior art hydraulic systems used to raise and lower a load, there is always the possibility that should hydraulic pressure not be maintained in the vent line the make-up valve could come open and the load could unexpectedly move. Such a situation could occur with, for example, air trapped in said vent line and the simultaneous failure of a pump of the system. The present invention solves this problem by providing pressure maintaining arrangement (200) in fluid communication with said vent line (93,94,95,99). The pressure maintaining arrangement (200) insures that any air trapped in the vent line (93,94,95,99) will be compressed to maintain the pressure in the vent line (93,94,95,99) at a predetermined level. Thus, should the hydraulic pump (13,26) be inoperative, a load will not unexpectedly move due to the compression of air trapped in said vent line (93,94,95,99).

7 Claims, 1 Drawing Figure

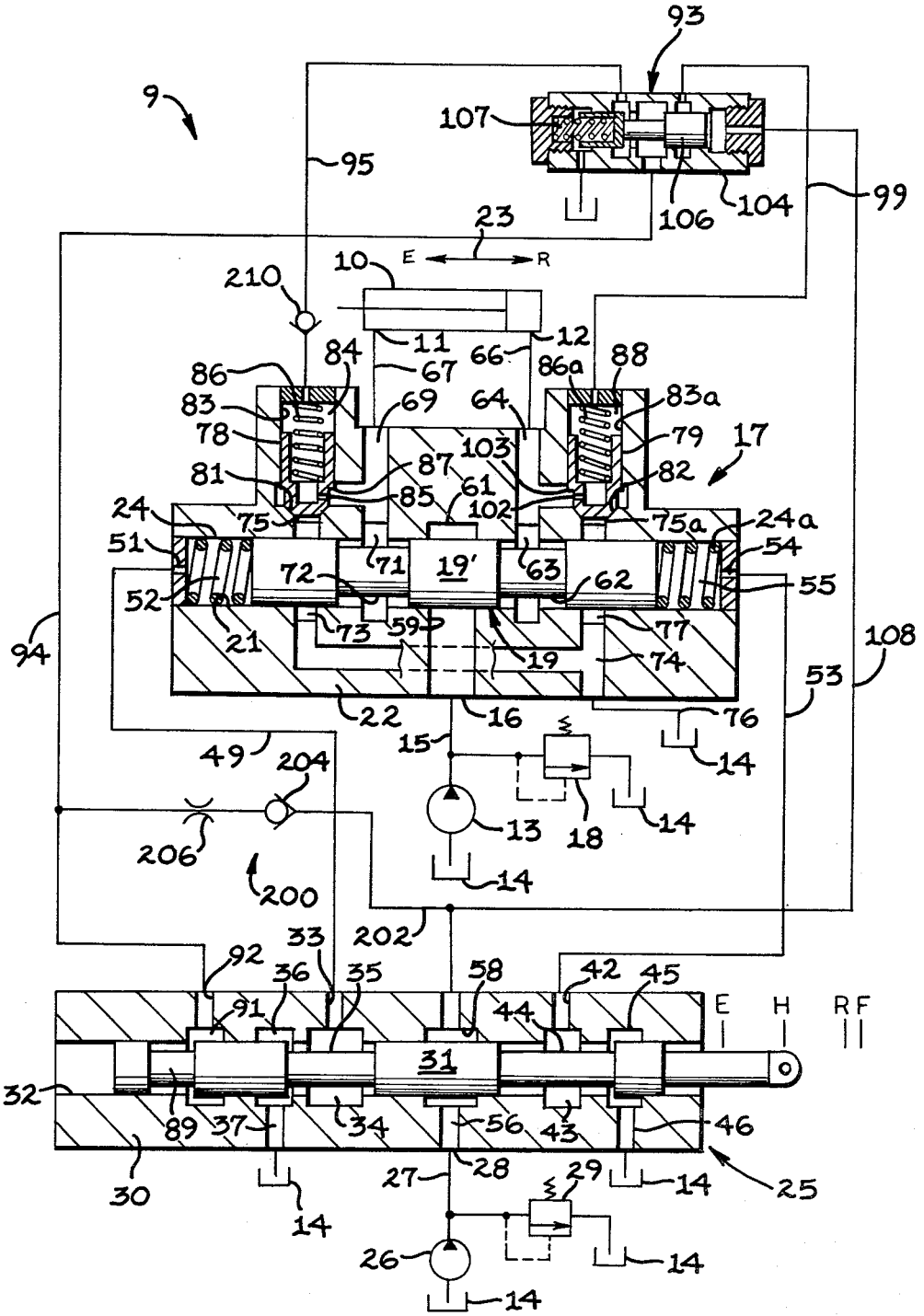
93
9
107
95
106
104
99
23
10
E
R
210
11
12
84
66
86a
88
86
67
83
69
64
83a
78
79
17
103
87
81
82
61
85
102
24
75
75a
24a
51
54
72
71
19'
63
62
55
52
73
59
77
21
19
74
108
94
53
22
16
76
15
14
49
204
18
14
13
206
200
14
202
33
92
36
35
58
42
45
E
H
RF
91
44
31
32
89
37
34
56
43
46
30
27
28
29
14
25
14
26
14
14

HYDRAULIC LOAD LIFTING SYSTEM WITH HYDRAULIC SURCHARGE TO MAKE UP VALVE PILOT LINES

DESCRIPTION

1. Technical Field

The present invention relates to hydraulic load lifting systems and, in particular, to systems including a main control valve, a pilot control valve for actuating said main control valve and a make up valve operatively associated with said main control valve.

2. Background Art

Prior art hydraulic systems, such as described in U.S. Pat. No. 3,840,049 issued in Oct. 8, 1974 to Jesse L. Field include a main control valve having hold, extend and retract modes, a pilot control valve for actuating said main control valve and a make up valve means operatively associated with said main control valve. Further a float mode is obtained by the hydraulic association of the pilot control valve with the make up valves to vent said make up valves.

The hydraulic means which associates the pilot control valve with the make up valves can include rather long hydraulic conduits. Further there is always a possibility that excessive amounts of air can be trapped in these hydraulic conduits. As such trapped air is compressible, it is possible, in certain circumstances, for the make up valve means to come open, allowing hydraulic fluid to flow into the conduits. Such an occurrence can happen, for example, when a load is being held by a hydraulic cylinder of the system and for some reason the hydraulic pump of the system ceases to operate. In such a situation, it is possible that load generated hydraulic pressure in the cylinder could cause hydraulic fluid to flow through orifices of the make up valve means, compressing the trapped air, opening said make up valve means, and allowing the load to unexpectedly move.

DISCLOSURE OF INVENTION

The present invention is directed to overcoming one or more of the problems as set forth above.

In one aspect of this invention, a hydraulic system comprises a hydraulic motor, a control valve for controlling said hydraulic motor, a make up valve means for providing make up fluid to said hydraulic control valve and a vent line means for venting said make up valve. The improvement includes means for maintaining a predetermined pressure level in said vent line means.

In another aspect of the invention, the pressure maintaining means includes a one-way valve and a restricting means. Fluid is communicated through the one-way valve and the restricting means to surcharge the vent line means. The one-way valve insures that hydraulic pressure is not lost from the vent line means and the restricting means insures that the hydraulic fluid surcharging the vent line means does not interfere with the venting of the make up valves through the vent line means.

In yet another aspect of this invention, the pressure maintaining means communicates with a pilot control valve which controls the control valve and therethrough with a pilot pressure pump.

In still another aspect of the invention a one-way valve is placed in the vent line means to insure that fluid therefrom does not flow into the make up valve means and interfere with the normal operations of a hydraulic motor.

Thus, it can be seen that with constant pressure applied to the vent line means, any air trapped therein will be automatically compressed, maintaining the vent line means at a predetermined selected pressure. Accordingly, if, for example, the hydraulic pump of the system should fail, a load held in position by a hydraulic motor will not unexpectedly move due to load pressurized hydraulic fluid being forced through the orifices of the make up valve means into the vent line means.

BRIEF DESCRIPTION OF THE DRAWINGS

The FIGURE illustrates a hydraulic system wherein valve bodies are shown sectioned and certain other components are shown schematically and wherein an embodiment of the pressure maintaining means of the invention is incorporated.

BEST MODE FOR CARRYING OUT THE INVENTION

The hydraulic system 9 into which the present invention is incorporated is disclosed in U.S. Pat. No. 3,840,049 issued on Oct. 8, 1974 to Jesse L. Field, which patent is incorporated herein by reference. For purposes of reference, the components of the hydraulic system of the aforementioned patent will be discussed below with the corresponding reference numerals that are used in said patent.

A linear motor 10 has two fluid ports 11 and 12 to which actuating fluid may be supplied. If actuating fluid is supplied to one such port 11, the motor retracts and fluid is discharged from the other port 12. If actuating fluid is supplied through port 12, the motor extends with fluid being discharged through the other port 11.

Pressurized fluid for driving the motor 10 is supplied by a pump 13 which draws fluid from a reservoir 14. The outlet of pump 13 is communicated to an inlet port 16 of a directional control valve 17 by way of a conduit 15. A relief valve 18 is connected between conduit 15 and reservoir 14 to establish a maximum fluid pressure which can be transmitted to the motor and to return excess fluid directly to the reservoir. Directional valve 17 has a first valve member or spool 19 located in a first bore 21 of a valve body 22 and the spool is movable axially to one of three positions which respectively constitute a hold position at which motor 10 is stopped. A retract position at which the motor is driven in the direction R indicated by arrow 23, and a third or extend position at which the motor is driven in the opposite direction E as indicated by arrow 23.

Spool 19 of valve 17 is urged toward a centered position in bore 21, which constitutes the hold position, by a pair of springs 24 and **24*a* situated in bore 21 at opposite ends of the spool. Fluid inlet port 16 commmunicates by means of a passage 59 with an annular groove 61 at the center of bore 21. Bore 21 has an additional groove 71 spaced to one side of input groove 61 and which is communicated with motor port 11 through a valve body passage 69, and conduit 67. Similarly, bore 21 has still another groove 63, on the opposite side of central input groove 61, that is communicated with the motor port 12 through a valve body passage 64 and conduit 66. Bore 21 has still additional grooves 73 and 77 spaced outwardly from grooves 71 and 63** respectively, which are each communicated with the reservoir 14 by a drain passage 74 in the valve body and a drain conduit 76.

Spool 19 has a pair of grooves 62 and 72 situated on opposite sides of a central land 19' of the spool. Accordingly, when the spool 19 is at the above-described centered or hold position, land 19' blocks driving fluid from both motor ports 11 and 12 while the end portions of the spool block communication between the two motor ports and drain passage 74. Thus, motor 10 is stopped and can neither extend nor retract. If spool 19 is shifted to the left, spool groove 62 communicates input port 16 with motor port 12 while spool groove 72 communicates motor port 11 with drain conduit 76 causing motor 10 to extend. Similarly, if spool 19 is shifted in the opposite direction spool groove 72 transmits driving fluid from input port 16 to motor port 11 while groove 62 vents motor port 12 to drain causing the motor to retract.

Spool 19 is shifted between the abovedescribed three positions for the purpose of controlling motor 10 in response to fluid pressure signals received through a manually controlled pilot valve 25. Pilot valve 25 has a body 30 with a bore 32 in which spool 31 is disposed for axial movement by the operator between four positions which are the extend (E), hold (H), retract (R) and float (F) positions. Pilot valve 25 receives pressurized fluid from a second pump 26 which draws fluid from reservoir 14 and transmits the flow to an input port 28 of the pilot valve through a conduit 27. A second relief valve 29 is connected between conduit 27 and reservoir 14 to establish the basic pilot fluid pressure and to return excess output of pump 26 to reservoir 14.

A valve body passage 56 communicates the input port 28 of pilot valve 25 with an annular input groove 58 at bore 32. Additional grooves 34 and 43 of bore 32 are situated at opposite sides of groove 58 and connect with output passages 33 and 42 respectively of the pilot valve. Conduits 49 and 53 respectively connect output passages 33 and 42 with ports 51 and 54 respectively at opposite ends of bore 21 of the directional control valve 17.

Bore 32 of the pilot valve has additional grooves 36 and 45 spaced outwardly from grooves 34 and 43 respectively. Groove 36 communicates with the reservoir 14 through a drain passage 37 while groove 45 connects with reservoir 14 through a passage 46. Spool 31 has spaced-apart grooves 35 and 44 which in the hold position of the spool communicate grooves 34 and 43 with drain grooves 36 and 45 respectively while the intervening portion of the spool blocks flow between input groove 58 and either of grooves 34 and 43. Thus, at the hold position of pilot valve 25, spring chambers 52 and 55 of directional control valve 17 are vented and the directional control valve assumes the hold position at which motor 10 is stopped.

When the operator shifts the spool 31 of pilot valve 25 to the extend position, pilot pressure from inlet port 28 is transmitted through grooves 58,44 and 43 and passage 42 to conduit 53 while conduit 49 is opened to reservoir 14 through passage 33, grooves 34, 35 and 36 and passage 37. This pressurizes spring chamber 55 of the directional control valve 17 while venting spring chamber 52. Directional control valve spool 19 is thereby shifted to the hereinbefore described position at which motor 10 is caused to extend.

Manual shifting of the spool 31 of pilot valve 25 to the retract position transmits pilot pressure from inlet groove 58 through grooves 35,34 and passage 33 to conduit 49 while conduit 53 is communicated with reservoir 14 through passage 42 and grooves 43,44 and 45. This action pressurizes spring chamber 52 of the directional control valve 17 while venting spring chamber 55. This shifts directional control valve spool 19 to the hereinbefore described position at which motor 10 is caused to retract.

Considering now means by which cavitation of motor 10 is forestalled, directional control valve 17 has a pair of cylindrical make-up valve members 78 and 79 disposed in additional bores 83 and 83*a* respectively of valve body 22 for axial movement therein. A spring 86 urges valve member 78 against a seat 81 through which bore 83 connects with a short passage 75 to groove 73 and thus with drain passage 74. Similarly, a spring 86*a* in bore 83*a* urges valve member 79 against a seat 82 through which the bore connects with passage 75*a* to groove 77 and drain passage 74. Accordingly, bores 83 and 83*a* respectively are normally blocked from communication with the drain passages by the valve members 78 and 79 but movement of either such valve member away from the associated seat 81 or 82 communicates the associated bore and motor port with drain passage 74.

An orifice 85 in the side of valve member 78 adjacent a shoulder 87 thereon communicates spring chamber 84 with flow passage 69 to motor port 11 and a side orifice 102 in valve member 79 adjacent a similar shoulder 103 thereof, transmits the fluid pressure of passage 64 to spring chamber 88. As the area of valve members 78 and 79 which is exposed to the pressure within spring chambers 84 and 88 is greater than the area of shoulder 87 and 103 on which the pressure acts oppositely, the valve members normally remain closed in the presence of pressure rises in the associated flow passages 69 and 64 except under certain conditions to be hereinafter described.

As previously described, during the retract mode of motor operation, driving fluid is directed to port 11 of motor 10. Under this condition, directional control valve passage 69 is pressurized while passage 64 is communicated with the reservoir 14. If at this time external load forces on motor 10 cause the motor to retract faster than is provided for by the flow of driving fluid into the motor 10 through passage 69, a pressure drop is produced therein which is communicated to spring chamber 84 through an orifice 85 in valve member 78. Simultaneously, a pressure rise is produced in passage 64 which is transmitted to passage 75 through drain passage 74. In a preferred embodiment the pressure in passage 69 is below atmospheric and the pressure in passage 75 is greater than that in passage 69. Accordingly, valve member 78 is lifted away from the associated seat 81 against the force of spring 86, allowing make-up fluid to enter passage 69. Although passage 75 is connected to reservoir 14, the flow conduit 76 therebetween constitutes a sufficient flow restriction that adequate pressure is present in passage 75 to lift the valve member 78 from its seat once the pressure within spring chamber 84 has dropped sufficiently due to the incipient cavitation of motor 10.

When valve member 78 lifts from seat 81 as described above, the supply of driving fluid passing to motor port 11 through passage 69 is supplemented by additional fluid from drain passage 74 which fluid is the discharge flow from the other side of motor 10. Thus, the net effect of valve member 78 is to provide for fluid to motor 10 when necessary to forestall cavitation.

The other make-up valve member 79 opens automatically to forestall cavitation during the extending movement of motor 10 in a manner essentially similar to that described above for the make-up valve member 78.

In order to provide an additional mode of operation of the system wherein the motor 10 may move in either direction as determined by an external load force thereon, generally termed the float position, the present invention provides structure which enables the fluid pressure bias which normally tends to hold the make-up valve member 78 closed to be selectively relieved in response to manual movement of the pilot control valve spool 31 to the float setting. In the absence of this fluid pressure bias in spring chamber 84, the make-up valve member 78 may lift from the associated seat 81 to provide for an exchange of fluid between ports 11 and 12 of the motor through valve 17 in response to an external load force acting thereon.

Considering now suitable structure for this purpose, if the pilot control valve 25 is shifted to the float position, pilot pressure from inlet port 28 is transmitted to directional control valve 17 in the same manner as was previously described for the retract position of the pilot valve which is closely adjacent the float position. Pressure from inlet port 28 is transmitted to spring chamber 52 of directional control valve 17 through conduit 49 causing the spool 19 of the control valve to shift to the position at which driving fluid is supplied to the motor port 11 while motor port 12 is communicated with reservoir 14. However, unlike the retract position, the float position of pilot valve 25 communicates an additional groove 91 in pilot valve bore 32 with drain passages 37 through an additional groove 89 on pilot valve spool 31.

A passage 92 and conduit 94 connect groove 91 with a float valve 93 which is in turn connected to spring chambers 84 and 88 through separate conduits 95 and 99 respectively. Float valve 93 is a two position valve having a body 104 and internal spool 106 biased by a spring 107 towards a position at which conduit 94 is communicated with conduit 99 while being blocked from conduit 95. A pilot line 108 transmits fluid pressure from groove 58 of manual pilot valve 25 to one end of valve 93 to shift spool 106 to an alternate position shown in the FIGURE whenever pump 26 is supplying fluid pressure. At this alternate position conduit 95 is communicated with conduit 94 while conduit 99 is blocked.

With manual pilot valve 25 shifted to the float position and with float valve 93 held at the alternate position by pilot pressure from pump 26, spring chamber 84 is vented to drain through conduit 95, valve 93, conduit 94, grooves 91 and 36 and passage 37. This enables the make-up valve member 78 to be lifted off the associated seat 81 by any pressure in passage 69 which acts against shoulder 87 or in response to pressure in passage 75 received through drain passage 74.

In effect this interconnects directional control valve inlet port 16, drain passage 74 and both of motor ports 11 and 12 to establish the desired float conditions of the system.

It may be observed that achieving the float position as described above requires that directional control valve spool 19 be shifted against spring **24*a* by pilot fluid pressure from pilot valve 25 as produced by pump 26. If the pilot pressure supply should fail for any reason, such as a breakdown of the engine which drives pump 26, the float condition cannot be realized in the particular manner described above. However, a dead engine load lowering condition for one direction of motor movement can be highly desirable under this circumstance in order to enable a load supported by motor 10** to be lowered by gravity. The above described system inherently provides for realizing the dead engine, load lowering condition for motor retraction in the event of pilot pressure failure, but in a somewhat different manner.

In particular, realization of the dead engine, load lowering condition as hereinbefore described requires venting of the pressure behind only a single one of the valve members 78 and 79, valve member 78 in this example, since spool 19 is shifted at that time by pilot pressure to effectively bypass the other make-up valve 79. However, if pilot pressure has failed, spool 19 is spring centered and a lowering condition for retracting can only be achieved by venting the spring chambers behind the other make-up valve member 79.

This occurs automatically since in the absence of pilot pressure, float valve 93 is spring shifted rightwardly in the FIGURE such that conduit 99 is communicated with pilot valve groove 91. If the pilot valve 25 is then shifted to the float setting spring chamber 88 is vented to enable the motor 10 to retract under the influence of an external load acting thereon.

The improvement of the invention includes pressure maintaining arrangement 200. Pressure maintaining arrangement 200 includes a conduit 202 which is provided in fluid communication at one end with pilot line 108 which provides pilot pressure from pilot pump 26 through pilot valve 25 to float selector valve 93. Conduit 202 communicates at its other end with conduit 94 which vents float selector valve 93 through the pilot 25 to the reservoir 14. Conduit 202 has incorporated therein a one-way valve 204 and a restrictor or orifice 206. One-way valve 204 is oriented such that it allows fluid to flow from conduit 108 to conduit 94, but prevents fluid flow in the reverse direction. As can be seen in the FIGURE, restrictor 206 is located between venting conduit 94 and one-way valve 204. However, as will be evident from the operation of the invention described herein below, orifice 206 can be effectively placed on the other side of one-way valve 204.

The improvement of the invention further includes another one-way valve 210 which is located in conduit 95 adjacent directional control valve 17. One-way valve 210 prevents the flow of fluid from float selector valve 93 through conduit 95 to the spring cavity 84, while allowing the fluid in spring cavity 84 to be vented through flow selector valve 93.

INDUSTRIAL APPLICABILITY

Without pressure maintaining arrangement 200 and check valve 210, should the pilot pump 26 fail and if air were trapped in conduit 94, load pressurized fluid in passage 64 could flow through orifice 102 into lines 99 and 94 compressing said trapped air and reducing the pressure in spring chamber **83*a*. The reduced pressure in chamber 83*a* is caused by the pressure drop across orifice 102, due to the small size thereof, and also to the restricted rate at which oil can fill chamber 88. Simultaneously load pressurized fluid could also place pressure at shoulder 103 causing the make up valve member 79 to be urged against the spring 86*a*, thereby reducing the volume in spring chamber 83*a*. Accordingly, the make up valve member 79 will come off of seat 82 allowing the fluid in passage 64 and thus the fluid in head end of the cylinder to be connected to reservoir 14**, allowing the load to drop.

The operation of the pressure maintaining arrangement 200 and check valve 210 in conjunction with the remainder of the hydraulic system to solve this problem as follows:

Conduit 202 is in fluid communication with conduit 108 which always communicates with pump 26 through valve 25 no matter where spool 31 is positioned. Consequently, line 202 is always charged with the pilot pressure provided by pump 26. With line 202 so charged, the fluid pressure opens one way valve 204 allowing hydraulic fluid to surcharge conduit 94. Should there be trapped air in line 94, the surcharge hydraulic fluid can compress the trapped air, maintaining the pressure in conduit 94 at a desired level.

Valve 204 closes when fluid tries to move from conduit 94 to conduit 108. Thus, the pressure in conduit 94 is maintained should, for example, the pilot pump 26 fail, reducing pilot pressure in conduit 108.

The orifice 206 restricts the flow of fluid through conduit 202 to conduit 94 such that the flow of fluid cannot be so great as to interfere with the venting of fluid from float selector valve 93 through conduit 94 to pilot valve 25 and reservoir 14.

Finally, one-way valve 210 serves to block hydraulic fluid from flowing into spring cavity 84 from conduit 95. Thus, valve 210 keeps such fluid from communicating with the rod end of the cylinder while the engine is running. Obviously such communication is not desirable as it could interfere with the precise positioning of the rod of the motor 10. Also, valve 210 prevents fluid from conduit 95 from maintaining the pressure in spring chamber 84 so as not to prevent make-up member 78 from coming off of seat 81 so that fluid can be provided to the rod end of motor 10 if cavitation occurs therein.

Other aspects, objects, and advantages of this invention can be obtained from a study of the drawing, the disclosure and the appended claims.

I claim:

1. In a hydraulic system (9) having a hydraulic motor (10), a control valve means (17) for controlling the hydraulic motor (10), a make-up valve means **(79,83*a*,88) for providing make-up fluid to the load supporting end (12) of the hydraulic motor (10) which make-up valve means (79,83*a*,88) includes an orifice (102) for hydraulically communicating the load supporting end (12) with said make-up valve means (79,83*a*,88) to urge said make-up valve means (79,83*a*,88) closed, vent line means (31,91,92,94,99) for selectively venting the make-up valve means (79,83*a*,88) to allow said make-up valve means (79,83*a*,88) to open, and selector valve means (93) for selectively preventing said vent line means (31,91,92,94,99) from venting the make-up valve means (79,83*a*,88) the improvement comprising means (26,200) for maintaining a predetermined pressure level in said vent line means (91,92,94,99), which includes a one-way valve means (204) for allowing fluid to be introduced into said vent line means (31,91,96,94,99) and a means (26) for providing pressurized hydraulic fluid to said vent line means (31,91,92,94,99)**.

2. The apparatus of claim 1 wherein said hydraulic system (9) includes another make-up valve means (78,83,84) for providing make-up fluid to the hydraulic motor (10) and another vent line means (95) for communicating the another make-up valve means (78,83,84) with said vent line means (31,91,92,94,99) via said selector valve means (93), and wherein the improvement further comprises a check valve means (210) in said another vent line means (95) for preventing fluid from flowing from said pressure maintaining means (26,200) through said another vent line means (95) to the another make-up valve means (78,83,84).

3. The apparatus of claim 1 wherein said pressure maintaining means (26,200) includes means (206) for restricting fluid flow to said vent line means (31,91,92,94,99).

4. The apparatus of claim 1 wherein said hydraulic system (9) includes another make-up valve means (78,83,84) for providing make-up fluid to the hydraulic motor (10) and another vent line means (95) for communicating the another make-up valve means (78,83,84) with the vent line means (31,91,92,94,99) and wherein said vent line means (31,91,92,94,99) includes a first conduit (94) and a second conduit (99) which are selectively provided in communication by said selector valve means (93), which second conduit (99) communicates with said make-up valve means **(79,83*a*,88), and wherein said another vent line means (95) includes a third conduit (95) which communicates said another make-up valve means (78,83,84) with said selector valve means (93), said selector valve means (93) additionally selectively providing fluid communication between said first conduit (94) and said third conduit (95) wherein the improvement further includes means (210) for preventing fluid from flowing through said third conduit (95) into said another make-up valve means (78,83,84)**.

5. The apparatus of claim 4 wherein said pressure maintaining means (26,200) is in fluid communication with said first conduit (94).

6. The apparatus of claim 4 including an actuator conduit means (108) for actuating said selector valve means (93), which actuator conduit means (108) is provided in communication with said pressure maintaining means (26,200).

7. The apparatus of claim 6, including means (107) for biasing said selector valve means (93) to provide communication between said first conduit (94) and said second conduit (99), said actuator conduit means (108) overriding said biasing means (107) to bias said selector valve means (93) to provide communication between said first conduit (94) and said conduit third (95).

* * * * *